United States Patent [19]

Cobleigh et al.

[11] 4,351,208

[45] Sep. 28, 1982

[54] FILM DISPENSER AND SLITTER

[75] Inventors: Wendall C. Cobleigh; Donald L. Barmore, both of Lincoln, Nebr.

[73] Assignee: Professional Marketing Associates, Lincoln, Nebr.

[21] Appl. No.: 188,531

[22] Filed: Sep. 18, 1980

[51] Int. Cl.[3] ..... B26D 7/00

[52] U.S. Cl. ..... 83/167; 83/408; 83/459; 83/922; 156/584

[58] Field of Search ..... 156/584; 225/34; 269/239; 83/167, 454, 455, 459, 408, 922

[56] References Cited

U.S. PATENT DOCUMENTS

| | | | |
|---|---|---|---|
| Re. 14,994 | 11/1920 | Blaylock | 156/584 |
| 1,745,379 | 2/1930 | Perry | 269/239 |
| 2,035,946 | 3/1936 | Cummings | 83/408 |
| 2,530,335 | 11/1950 | Krueger et al. | 83/922 |
| 2,747,664 | 9/1956 | Lorson | 83/922 |
| 2,988,944 | 6/1961 | Bevier | 83/922 |

*Primary Examiner*—Stephen G. Kunin
*Assistant Examiner*—K. Bradford Adolphson
*Attorney, Agent, or Firm*—Zarley, McKee, Thomte, Voorhees & Sease

[57] ABSTRACT

A film dispenser and slitter is described which is comprised of an upstanding ladder-like support member which has forward and rearward ends. An elongated horizontally disposed support is mounted on the upper end of the support member and has opposite ends. First and second roll support members are mounted on the support for supporting a roll of film therebetween above the support. The roll support members are selectively slidably mounted on the support to permit the apparatus to accommodate rolls of various lengths to be supported therebetween. First and second bracket members are positioned at the opposite ends of the support and extend upwardly therefrom. A first film support bar is secured to the first and second bracket members and extends therebetween above the support. A film holding bar assembly is pivotally mounted on the first and second bracket members and includes a film holding bar which is pivotally movable from an inoperative position generally above the first film support bar to an operative position wherein the film holding bar is closely positioned adjacent the forward end of the support to yieldably maintain a sheet of film therebetween. At least one film slitter is selectively movably mounted on the support for slitting film as a sheet of film is pulled downwardly from the roll of film positioned thereabove. The support has a horizontally disposed film cutting edge provided thereon for facilitating the sheet of film to be cut to a predetermined length. The first film support bar has a vertically disposed forwardly presented surface whereby the upper end of the sheet of film, after the sheet of film has been cut to the desired length, may be moved upwardly from the film cutting edge and secured to the forwardly presented surface for facilitating the removal of any backing material from the sheet of film.

5 Claims, 14 Drawing Figures

FILM DISPENSER AND SLITTER

BACKGROUND OF THE INVENTION

Reflective film material is frequently applied to windows or the like to prevent the rays of the sun from passing therethrough. The reflective film ordinarily comes in rolls and has a backing or liner sheet which normally covers the adhesive material on one side of the film. The reflective film is extremely expensive and is very difficult to handle.

Prior art devices have been provided for supporting a roll of the film on a support to facilitate the cutting of the film material into sheets having the desired width and length. The prior art devices are not convenient to use since there is not a convenient means for supporting the film after it has been cut whereby the backing layer may be removed therefrom.

Therefore, it is a principal object of the invention to provide an improved film dispenser and slitter.

A further object of the invention is to provide a film dispenser and slitter including means for supporting rolls of film of various lengths.

A still further object of the invention is to provide a film dispenser and slitter which includes means for holding the film in position as it is being cut.

A still further object of the invention is to provide a film dispenser and slitter which includes means for supporting the film as the backing material is being removed therefrom.

A still further object of the invention is to provide a film dispenser and slitter which may be used by an individual without additional help.

A still further object of the invention is to provide a film dispenser and slitter which is economical of manufacture, durable in use and refined in appearance.

These and other objects will be apparent to those skilled in the art.

SUMMARY OF THE INVENTION

Figure 1:
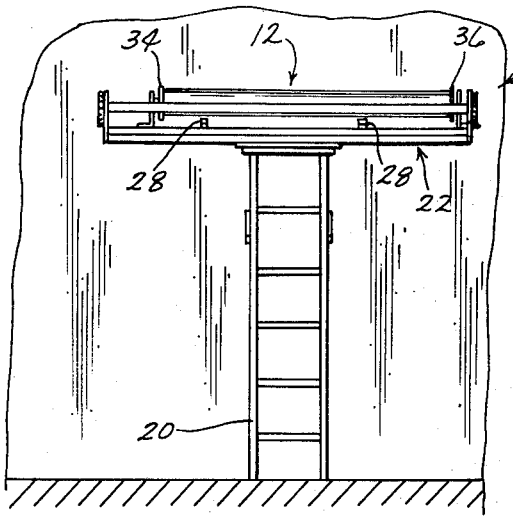
FIG. 1 is a front view of the film dispenser and slitter of this invention.

A film dispenser and slitter is disclosed which includes means for supporting various roll lengths of reflective film. Adjustably movable slitters are provided on the apparatus to slit the roll of film into the desired sheet width as the film is pulled from the roll. Means is provided for maintaining the sheet in position as it is being cut to the desired length. Likewise, a taping bar is provided for supporting the film as the backing material is being removed therefrom.

DESCRIPTION OF THE PREFERRED EMBODIMENT

The film dispenser and slitter apparatus of this invention is referred to generally by the reference numeral 10 while the reference numeral 12 refers to a roll of the reflective film as normally wound upon a core 14. The film 12 comprises the actual reflective film member 16 and a backing or liner 18 which is peeled from the member 16 to expose the adhesive surface thereon to enable the member 16 to be placed on a window or the like.

Figure 4:
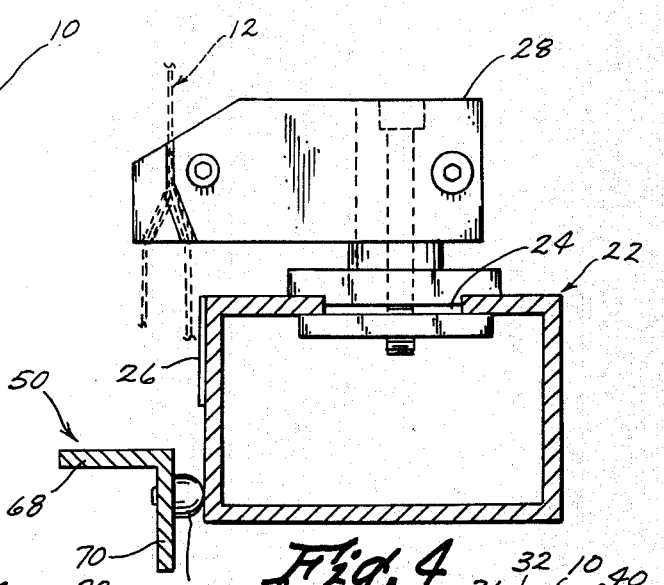
FIG. 4 is an enlarged sectional view taken on lines 4—4 of FIG. 2.
Figure 2:
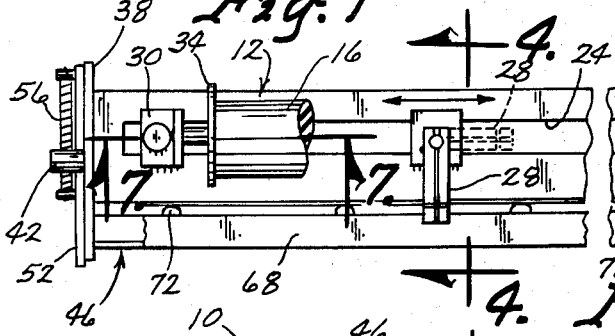
FIG. 2 is a partial top view of the invention.
Figure 2:
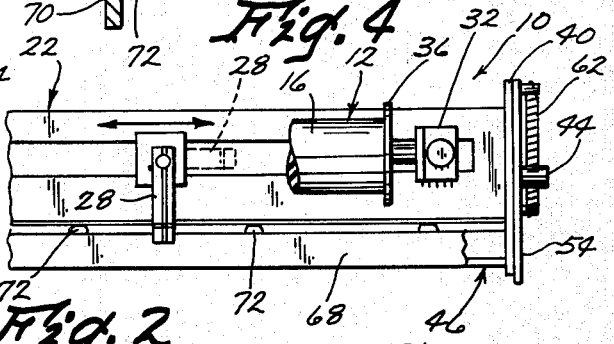
Figure 3:
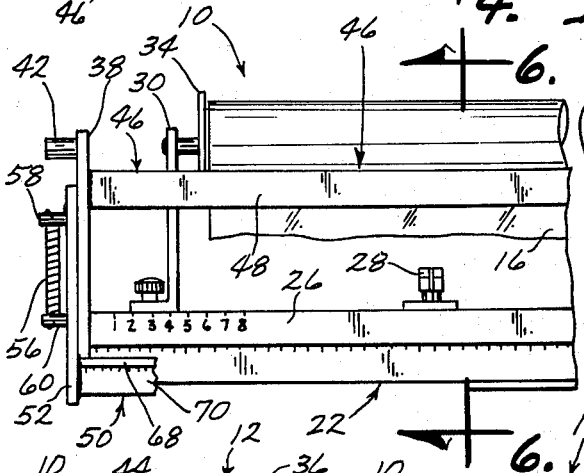
FIG. 3 is a partial front view of the invention.
Figure 3:
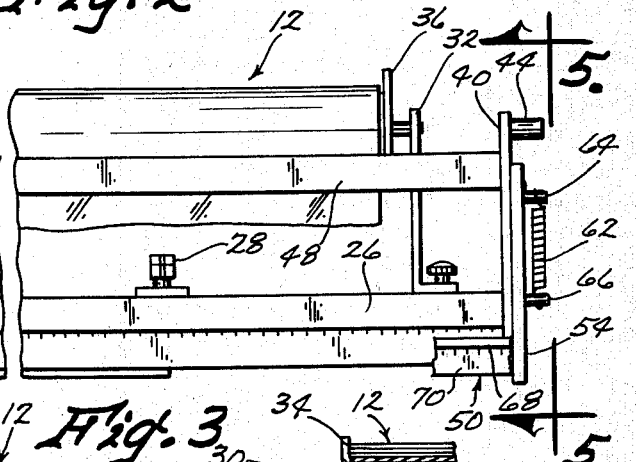
Figure 5:
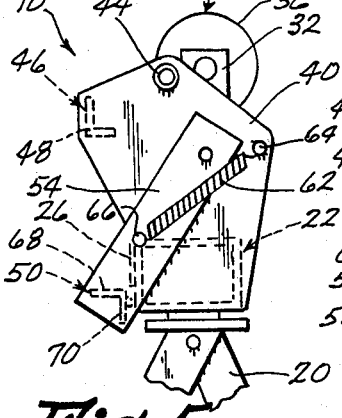
FIG. 5 is a sectional view taken on lines 5—5 of FIG. 3.

Apparatus 10 includes a ladder-like support 20 upon which is mounted a horizontally disposed beam or support means 22 having an elongated opening 24 formed in the upper surface thereof. The upper forward portion of the support means 22 is provided with an indicia scale referred to generally by the referenced numeral 26. At least one film slitter apparatus 28 is selectively slidably mounted on the support means 22 as best illustrated in FIG. 4. Slitter 28 is provided with a blade mounted therein adapted to slit the film as the film is passed therethrough so that a predetermined sheet width is achieved.

Figure 7:
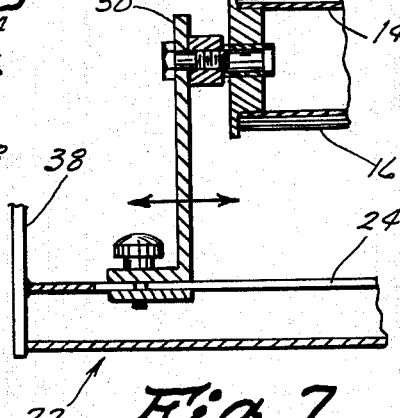
FIG. 7 is an enlarged sectional view taken on lines 7—7 of FIG. 2.

A pair of spaced-apart brackets 30 and 32 are selectively mounted on the support means 22 as best seen in FIG. 7. Brackets 30 and 32 are provided with rotatable chucks 34 and 36 at their upper ends which are adapted to engage the ends of the roll of film as best illustrated in FIG. 7. The brackets 30 may be selectively moved with respect to the support means 22 and with respect to each other so as to accommodate various roll lengths.

Plates 38 and 40 are secured to the opposite ends of support means 22 and extend upwardly therefrom. The plates 38 and 40 are provided with horizontally extending stops 42 and 44 respectively for a purpose to be described hereinafter. A film support bar or taping bar 46 is secured to and extends between the upper ends of the plates 38 and 40 and has a vertically disposed and forwardly presented surface 48.

Figure 6:
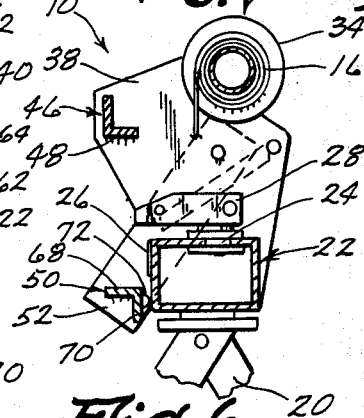
FIG. 6 is a sectional view taken on lines 6—6 of FIG. 3.
Figure 8:
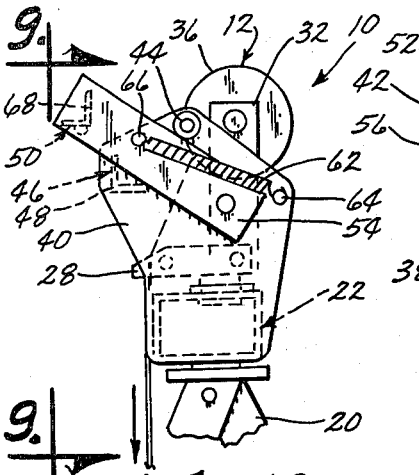
FIGS. 8, 10 and 12 are views similar to FIG. 5 illustrating the sequence of the dispensing and slitting operation.
Figure 9:
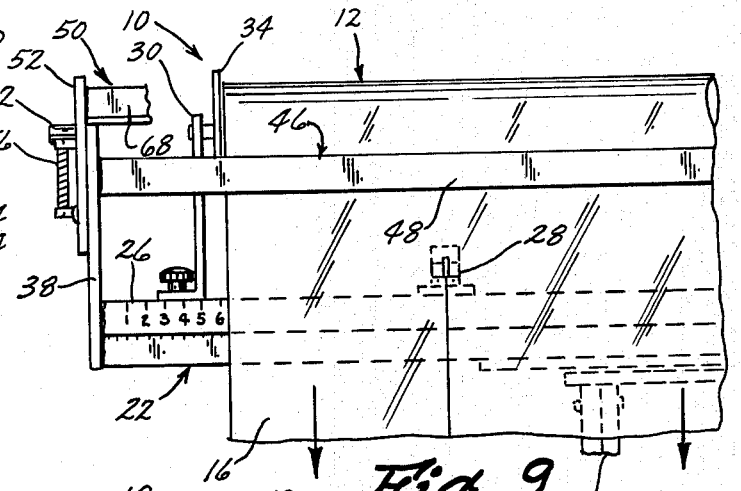
FIG. 9 is a view taken on lines 9—9 of FIG. 8.
Figure 10:
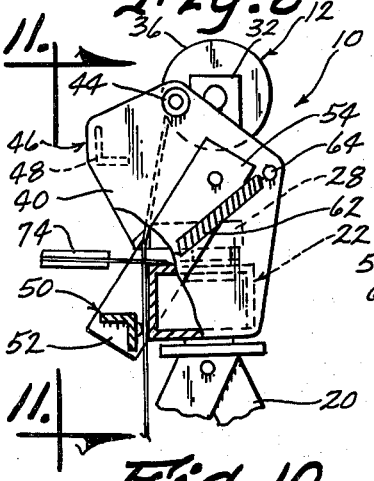

The numeral 50 refers to a film holding bar assembly which is pivotally mounted on the plates 38 and 40. Assembly 50 comprises arms 52 and 54 which are pivotally mounted on the plates 38 and 40 respectively. Spring 56 extends between post 58 on plate 38 and post 60 on arm 52 to yieldably maintain the arm 52 in either the position illustrated in FIG. 6 or the position illustrated in FIG. 8. Likewise, spring 62 extends between post 64 on plate 40 and post 66 on arm 54. Bar 68 is secured to and extends between the ends of the arms 52 and 54 and is provided with a vertically disposed and rearwardly presented face 70 which is preferably provided with a film gripping means 72 thereon such as rubber, felt or other soft material to enable the bar 68 to yieldably maintain the film 12 between the rearwardly presented face of the bar 68 and the lower forward surface of the support means 22 when the bar 68 is in the position illustrated in FIGS. 10 and 12.

The method of using the apparatus is as follows. The roll of film 12 is positioned between the brackets 30 and 32 so that the chucks 34 and 36 are received in the ends thereof with the brackets 30 and 32 being selectively slidably moved on the support means 22 to properly position the roll. The adjustable feature of the brackets 30 and 32 permits the brackets to accommodate rolls having various lengths. The slitters 28 are also slidably moved on the support means 22 so that the film will be cut into the proper widths. Bar 68 is positioned in the position illustrated by FIG. 8 at this time. The film is pulled downwardly from the roll behind the bar 68 and through the slitters 28. The film is pulled downwardly until the proper length has been slit. Bar 68 is then pivotally moved downwardly from the position of FIG. 8 to the position of FIG. 10 so that the film is gripped between the bar 68 and the lower forward surface of the support means 22. A knife 74 or the like is then used to cut the film in the manner illustrated in FIGS. 10 and 11. It should be noted that the film is pulled from the roll until the desired edge of the film is in alignment with the upper forward edge of the support means 22. The knife 74 is then moved horizontally using the upper forward surface of the support means 22 as a guide so that a horizontal cut is formed in the film.

Figure 11:
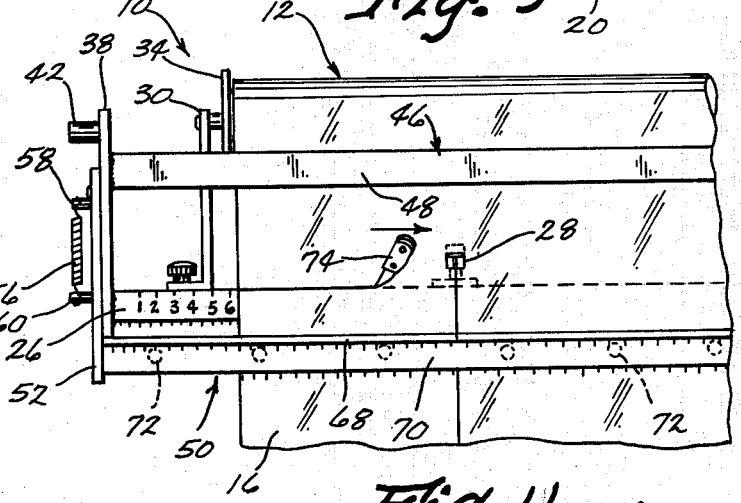
FIG. 11 is a view taken on lines 11—11 of FIG. 10.
Figure 12:
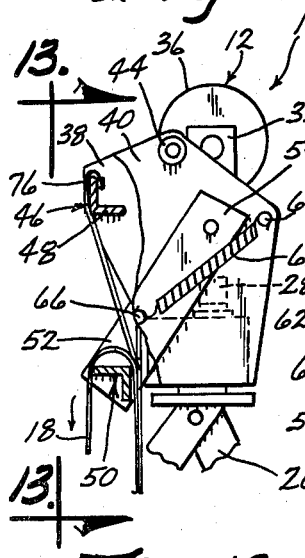
Figure 13:
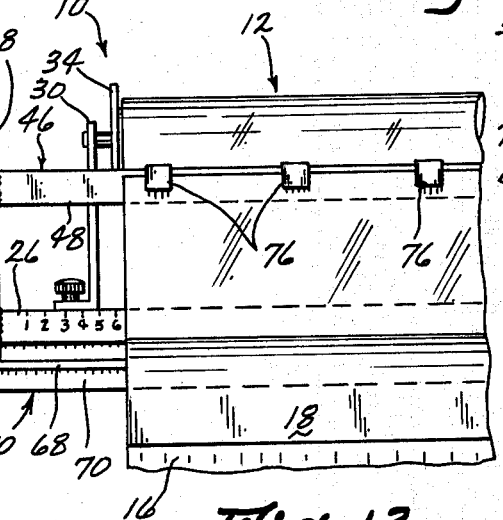
FIG. 13 is a view taken on lines 13—13 of FIG. 12.
Figure 14:
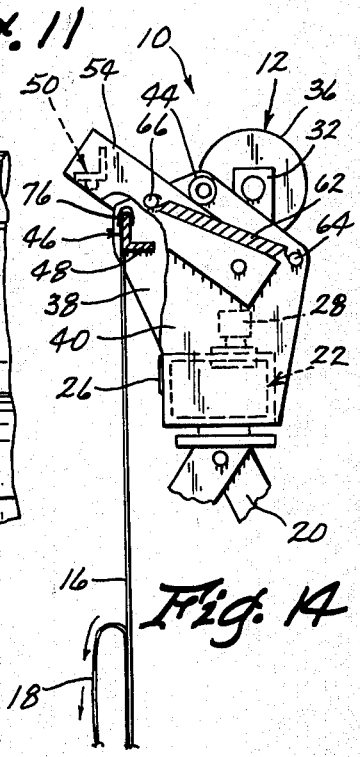
FIG. 14 is a view similar to FIGS. 8, 10 and 12 which illustrates the backing material being removed from the film.

The upper end of the severed film is then pulled upwardly from the position of FIG. 11 to the position of FIG. 12 so that the upper end thereof is positioned adjacent the forwardly presented vertical face 48 of the bar 46. Tape 76 is then employed to secure the upper end of the film to the bar 46. The backing material or layer 18 is then pulled from the film 16 downwardly until further downward movement is prevented by the bar 68. Bar 68 is then pivotally moved upwardly from the position of FIG. 12 to the position of FIG. 14. The backing material 18 is then pulled downwardly as illustrated in FIG. 14. The material 18 is completely removed from the film 16 and the film 16 is then applied to the window or the like in conventional fashion.

Thus it can be seen that a novel film dispenser and slitter has been provided which not only accommodates various roll lengths but which permits the film to be cut into the desired widths in a convenient method. It can also be seen that a novel means has been provided for supporting the film while the backing material or layer is removed therefrom. An individual may easily perform all of the operations described hereinabove which substantially reduces the amount of labor normally associated with the task of cutting and placing film on a window or the like. Thus it can be seen that the invention accomplishes at least all of its stated objectives.

We claim:

1. A film dispenser and slitter, comprising, an upstanding support member having forward and rearward ends, an elongated horizontally disposed support means mounted on the upper end of said support member and having opposite ends, first and second roll support members mounted on said support means for supporting a roll of film therebetween above said support means, at least one of said roll support members being selectively slidably mounted on said support means to permit rolls of various lengths to be supported therebetween, first and second bracket members at the opposite ends of said support means and extending upwardly therefrom, a first film support bar secured to said first and second bracket members and extending therebetween above said support means, at least one film slitter selectively movably mounted on said support means for slitting film as a sheet of film is pulled downwardly from the roll of film positioned thereabove, said support means having a horizontally dipsosed film cutting edge provided thereon below said film slitter for facilitating the cutting of the sheet of film to a predetermined length after it has been slit, a film holding bar assembly operatively pivotally mounted on said first and second bracket members and including a film holding bar which is pivotally movable from an inoperative position generally above said first film support bar to an operative position wherein said film holding bar is closely positioned adjacent the forward end of said support means to yieldably selectively maintain a sheet of film therebetween at times while said sheet is being cut to its predetermined length and after said sheet has been so cut, said first film support bar having a forwardly presented surface whereby the upper end of the sheet of film, after the sheet of film has been cut to the desired length, may be moved upwardly from said film cutting edge and secured thereto for facilitating the removal of backing material from said sheet of film, said film holding bar yieldably engaging said sheet of film as said sheet is moved upwardly for attachment to said film support bar.

2. The apparatus of claim 1 wherein both of said first and second roll support members are selectively slidably mounted on said support means.

3. The apparatus of claim 1 wherein a pair of film slitters are selectively movably mounted on said support means.

4. The apparatus of claim 1 wherein said film holding bar assembly comprises first and second arm members pivotally secured to said first and second bracket members respectively, said film holding bar being secured to and extending between said first and second arm members, and spring means connected to at least one of said arm members for yieldably maintaining said film holding bar in its operative and inoperative positions.

5. The apparatus of claim 1 wherein a film gripping means is provided between said film holding bar and the forward end of said support means for yieldably gripping the sheet of film positioned therebetween.

* * * * *